US005664832A

United States Patent [19]

Stevens et al.

[11] Patent Number: 5,664,832

[45] Date of Patent: Sep. 9, 1997

[54] SEMI-FITTED SINGLE PIECE RECLINER COVER

[75] Inventors: Kenneth V. Stevens, Brooklyn; Paula Riley, New York, both of N.Y.

[73] Assignee: Prescient Partners, L.P., New York, N.Y.

[21] Appl. No.: 674,022

[22] Filed: Jul. 1, 1996

[51] Int. Cl.[6] ..... A47C 31/10

[52] U.S. Cl. ..... 297/225; 297/228.12; 297/228.13; 297/228.11; 297/68

[58] Field of Search ..... 297/225, 228, 297/229, 228.12, 228.13, 228.11, 218.4, 219.1, 85, 68, 423.3

[56] References Cited

U.S. PATENT DOCUMENTS

| | | | |
|---|---|---|---|
| Re. 24,279 | 2/1957 | Schutte et al. . | |
| Re. 25,133 | 3/1962 | Reavis et al. . | |
| D. 137,638 | 4/1944 | Spiro . | |
| D. 257,084 | 9/1980 | Fuller et al. . | |
| D. 283,475 | 4/1986 | Reece . | |
| D. 307,847 | 5/1990 | Hird . | |
| 315,415 | 4/1885 | Mygatt . | |
| D. 359,411 | 6/1995 | Wade . | |
| 1,303,021 | 5/1919 | Brock . | |
| 1,861,455 | 6/1932 | Schwartz | 297/229 |
| 1,933,372 | 10/1933 | Fisher | 297/228 X |
| 2,027,947 | 1/1936 | Witcoff . | |
| 2,174,046 | 9/1939 | Smith . | |
| 2,254,466 | 9/1941 | Albert . | |
| 2,350,359 | 6/1944 | Krasnov et al. | 297/228 X |
| 2,367,450 | 1/1945 | Trubitz . | |
| 2,800,169 | 7/1957 | Armbrecht | 297/225 |
| 2,811,198 | 10/1957 | Krogh | 297/225 |
| 2,820,510 | 1/1958 | Sugarman . | |
| 2,828,812 | 4/1958 | Buford | 297/228 |
| 2,884,993 | 5/1959 | Schutte . | |
| 3,116,953 | 1/1964 | Sugarman | 297/225 |
| 3,185,197 | 5/1965 | Spiro et al. . | |
| 3,195,950 | 7/1965 | Mednick . | |
| 4,396,227 | 8/1983 | Neilson | 297/228.12 X |
| 4,553,785 | 11/1985 | Duke, Jr. et al. . | |
| 4,838,610 | 6/1989 | Perrin | 297/225 |
| 4,891,454 | 1/1990 | Perdelwitz et al. . | |
| 5,156,441 | 10/1992 | Byersmith et al. | 297/85 X |
| 5,167,267 | 12/1992 | McQuaid . | |
| 5,275,463 | 1/1994 | Rocha . | |
| 5,320,407 | 6/1994 | Tell . | |
| 5,326,153 | 7/1994 | Muffi | 297/68 X |
| 5,388,702 | 2/1995 | Jones . | |
| 5,494,330 | 2/1996 | Fotsch . | |
| 5,510,167 | 4/1996 | Candolfi et al. . | |

FOREIGN PATENT DOCUMENTS

| | | | |
|---|---|---|---|
| 450579 | 8/1948 | Canada | 297/228 |
| 1511646 | 2/1968 | France | 297/228.13 |
| 949825 | 2/1964 | United Kingdom | 297/228 |

*Primary Examiner*—Peter M. Cuomo
*Assistant Examiner*—David E. Allred
*Attorney, Agent, or Firm*—Notaro & Michalos P.C.

[57] ABSTRACT

A one-piece recliner cover is made of a cross shaped fabric cover member having a head portion for engaging the back of the recliner, a foot portion for engaging the footrest of the recliner and a pair of arm portions for engaging the arms of the recliner. A tube is provided at the outer ends of the arm portions and receives an elastic belt or cord for engagement around the bottom of the recliner. A back panel is connected to one of the arm portions for engagement around the back of the recliner and over the back of the head portion. The head and foot portions can be sock shaped sleeves or flat panels. Sufficient room is left in the seat which connects the head, foot and arm portion to each other, so that the seat portion can be tucked around the recliner seat cushion. A tube for receiving a gripping member can be provided in the junction between the head portion and the seat portion. The grip member can be pushed down into the crease between the back and the seat cushion to firmly stabilize the cover onto the recliner.

14 Claims, 3 Drawing Sheets

25
62
25
70
12
72
25
59
50
59
25
56
56
62
18
20
19
16
62
19
74
14
54
25
25

SEMI-FITTED SINGLE PIECE RECLINER COVER

FIELD AND BACKGROUND OF THE INVENTION

The present invention relates, in general, to furniture slipcovers, and in particular, to a new and useful slipcover that is specially designed for recliner chairs and the like.

The popular recliner or motion chair typically has a long and well used life in the American household. Because it is a favorite, it is frequently soiled from the many bodies that plop in it and stay and snack and snooze. But, due to its mechanized state, it is also difficult to re-upholster by conventional means. Even custom made slip covers are hard to attach. Due to its relatively high cost, people are loath to get rid of their recliners, even when they have become worn and unsightly.

Presently, there are two commercially available cover sets on the market. One is a five-piece cover set with individual fabric components, each made of shaped, stretchy, synthetic fabric with elasticized gathers. The five dedicated pieces are stretched, in turn, over the chair back (1 piece), sides (2 pieces), seat (1 piece), and footrest (1 piece). Difficult to attach, this is a low priced, non-stylish product. It fits only the older recliners with separate pad footrests and cannot be attached to the newer continuous, flexing seat cushion with extended footrest designs.

A second product has been introduced in the recent past. It is a three-piece product, consisting of a large fabric rectangle—100 in.×115 in.—and two elasticized fabric skirts. The main cover is draped over the chair and tucked in around the seat cushion with the aid of short plastic inserts. The rest of the overhanging sheet of fabric is wrapped around the chair's outer contours. It is secured in place by a large number of screw pins and the excess fabric is pushed under the chair. The problematic moving footrest is covered by wrapping it and securing it on its underside with the aid of two fabric ear-like ties which are formed at one end of the main cover by diagonal slits. A 10 ft. long skirt is attached along the base of the chair, going from the front of one arm, along the side, to the back, along the other arm and ending inside the front of the other arm, also secured with screw pins. The other 8 ft. skirt loop is wrapped around the bottom of the footrest. This three piece cover is time-consuming to attach and subject to displacement and frequent shifting in use. The screw pins damage the chairs upholstery whether it is fabric, leather or Naugahyde material (a trademark). The skirt on the footrest is an ungainly presence and particularly easy to displace with the user's feet.

SUMMARY OF THE INVENTION

The present invention is a single-piece, semi-fitted recliner cover and embodies a substantial improvement over any known products. It is quick and easy to install and conforms to the full range of motion chair styles. It is secure in its placement on the chair and stays un-rumpled through continued use. It can be removed quickly for cleaning and uses no surface damaging pins. The single piece cover has two main elements. The first is a head portion which covers the back of the chair. It is comprised of two uniquely cut pattern pieces sewn to slip over the chair back like a sock. A wide "T"-shaped element is sewn to the head portion at its lower front edge where the seat meets the back, forming a cross shaped member. The widest portion of the "T" covers the chair from the outside base of one arm, over the arm rest, tucking in deeply around the seat cushion, up over the other arm rest and down to the outside base. An integral, perpendicular foot portion of the "T" or cross, covers the footrest and wraps beneath it with a sewn on bottom panel piece. An additional rectangle is sewn at a right angle to the right arm wrap. This section bridges the space between the rear corners as it zips, or is otherwise secured to the other corner when installed. The rear base of the back cover is held beneath this back portion. Two runs of adjustable elastic bands, encased in fabric tubes, surround the chair's lower perimeter area, excluding the footrest, one at the base and one below the arm rests. The two bands are each tethered at the zipper edges, run through the encasements or tubes and emerge at the arm fronts, where they are joined with clips or buckles behind the footrest. The bands can be adjusted in length to give the cover a snug contoured fit.

The cover fabric that gathers at the front of each arm is held smartly in place by the upper elastic band. The cover fabric is secured around the seat cushion by deeply tucking in three separate one foot long sections of an elastomeric wedge-shaped grip member. The grip member at the back of the seat is actually inserted into a sewn pocket or tube before it is tucked in, to seat the cover firmly in place. As a last step, an upper tab of the bottom side of the foot portion is wrapped around the uppermost elastic band and attached to itself with hook and loop or similar fastening means.

A variation of the above described embodiment is one in which the sewn and shaped back and footrest sections are replaced by flat sheets of fabric which have side-securing closures, such as hook and loop fasteners, to give the cover its close contouring shape on the back and footrest.

Accordingly, an object of the present invention is to provide a recliner cover for a recliner having a seat with a cushion, a back, a pair of arms and a movable footrest, the cover comprising a cross shaped fabric cover member, the cover member having a head portion for engagement over the recliner back, a foot portion for engagement over the recliner footrest, a pair of arm portions for engagement over the recliner arms and a seat portion for covering the seat and sized for being tucked down around the cushion. The pair of arm portions are connected to opposite sides of the seat portion. The head portion is connected to a top end of the seat portion and the foot portion is connected to a bottom end of the seat portion. Skirt means are connected to outer ends of the arm portions which are spaced away from the seat portion for fastening around and covering a bottom of the recliner.

A further object of the present invention is to use at least one band or cord to form part of the skirt means, and to provide the outer end of the foot portion with a tube forming structure which can engage the band or cord, under the footrest.

A still further object of the invention is to provide a sleeve or tube in the junction between the head portion and the seat portion, for receiving an elongated grip member of the type disclosed in U.S. patent application No. 08/270,057 (now U.S. Pat. No. 5,547,249) and in U.S. design patent application No. 29/039,100 (now U.S. Des. 377,899). The grip member helps lock the tucked in fabric behind the seat cushion in the recliner, further stabilizing the cover on the recliner.

According to further features of the invention, the head and foot portions may be in the form of semi-fitted sleeves for engaging the recliner back and footrest, or flat panels of fabric for being wrapped around and thereby engaging the recliner back and footrest.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
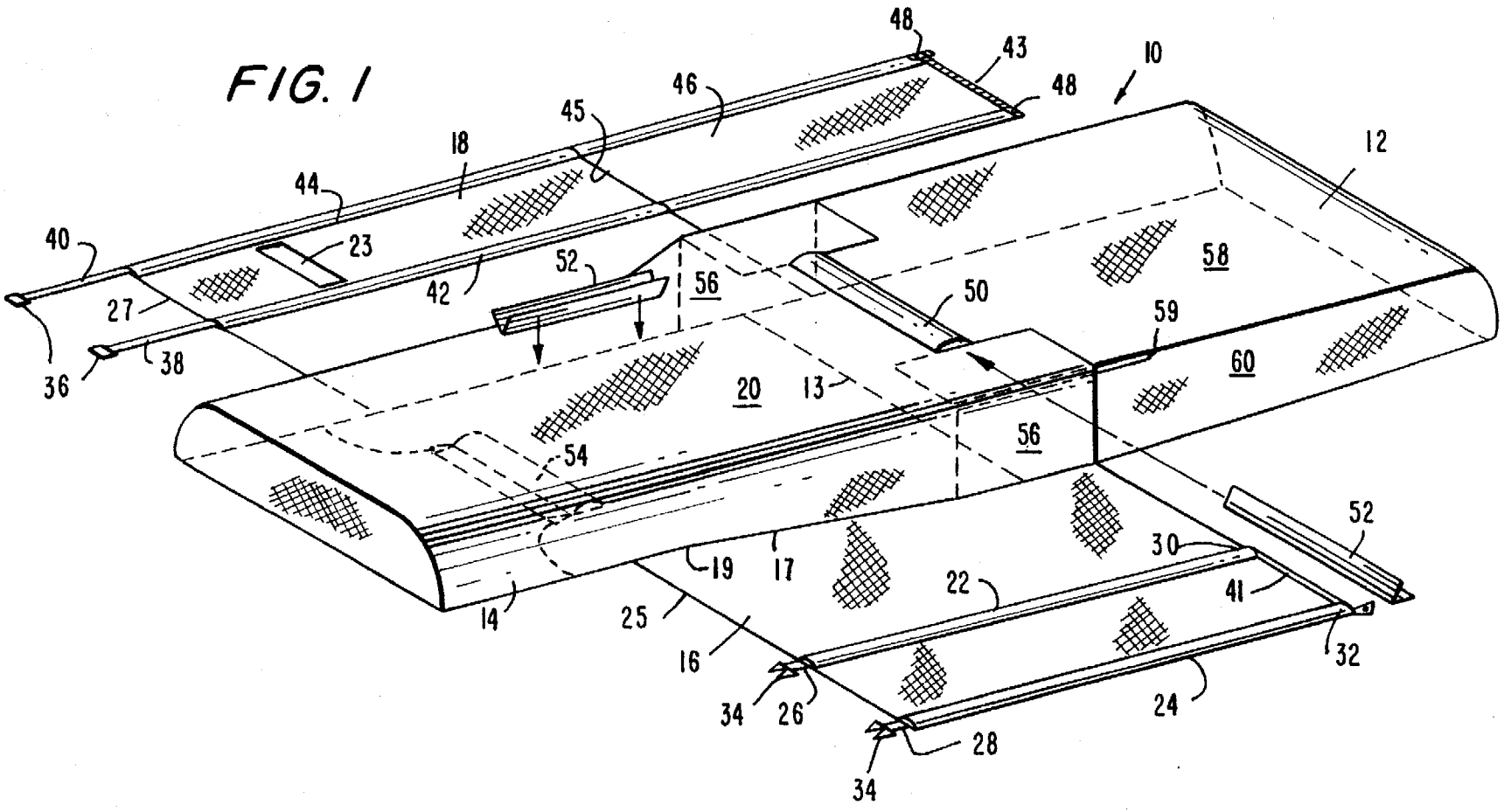
FIG. 1 is a perspective view of a semi-fitted single piece recliner cover according to the present invention.
Figure 2:
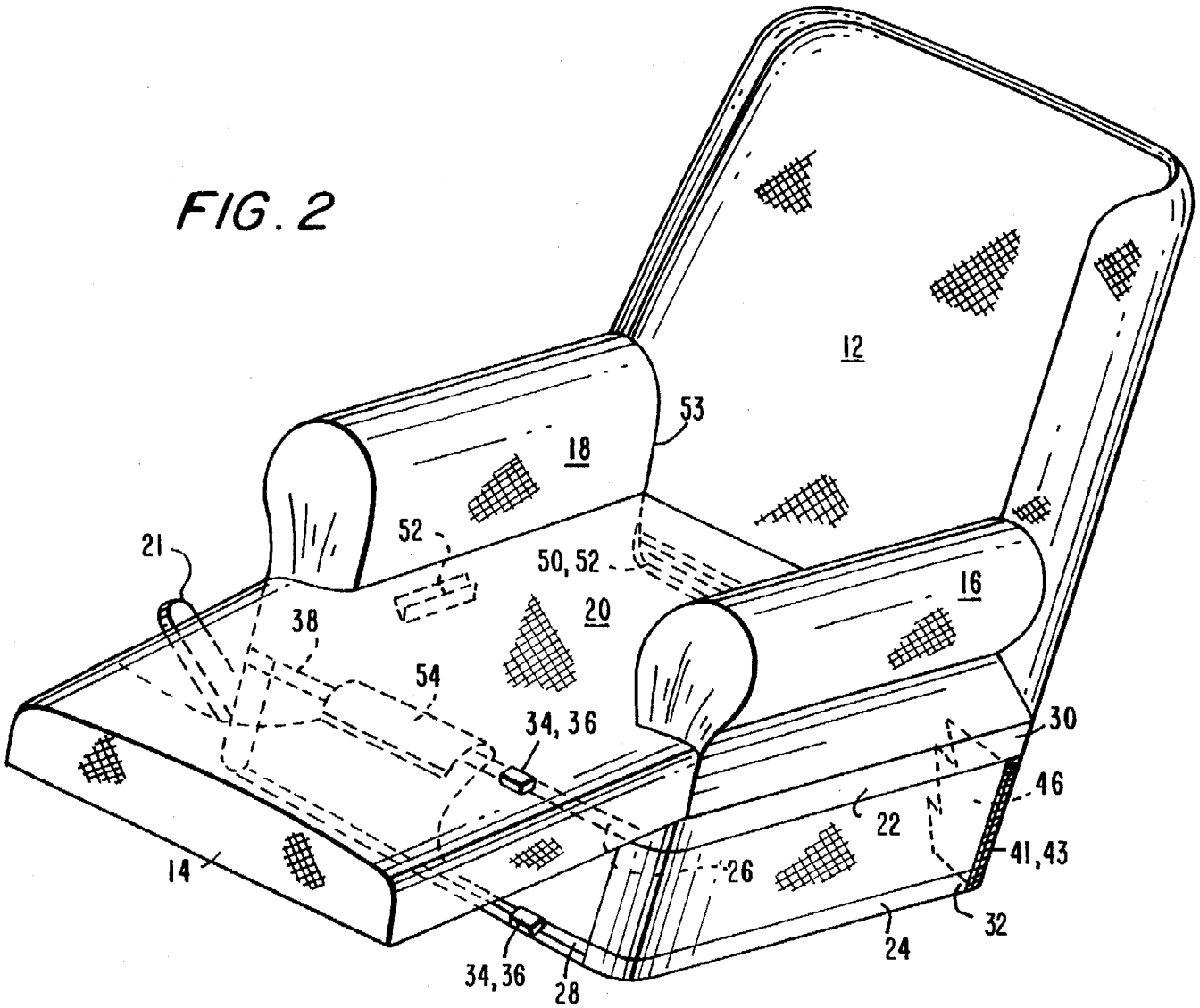
FIG. 2 is a perspective view of a recliner covered with the recliner cover of the present invention.

Referring to the drawings in particular, the invention embodied in FIGS. 1 and 2, comprises a semi-fitted, single piece recliner cover generally designated 10, comprising a cross-shaped fabric cover member having a head portion 12 for engagement like a sock or sleeve over the recliner back, a foot portion 14, also in the form of a sock or sleeve for engagement over the recliner footrest, and a pair of arm portions 16 and 18 for engagement over the recliner arms. A seat portion 20 which includes a generous supply of fabric, covers the seat and is sized for being tucked around the cushion without disturbing the positions of the head, foot and arm portions.

The pair of arm portions are connected to opposite sides of the seat portion 20 with the head portion 12 being connected to the top end of the seat portion, and the foot portion 14 being connected to the bottom end of the seat portion, to complete the cross-shape.

Skirt means in the form of a pair of spaced fabric tubes 22 and 24 are sewn to the outer end of arm portion 16, at a location spaced from the seat portion 20. Tube 24 is sewn at the outer edge of arm portion 16, and tube 22 is spaced from tube 24 and at a location spaced from the seat portion 20, to extend at a level just under the raised footrest as shown in FIG. 2. Each tube 22, 24 contains an elastic band 26, 28 which are tethered or sewn only at one base end to the interior of the tubes 22, 24, at tether points 30, 32.

This permits the full length of bands 26 and 28 to slide within the tubes, allowing the tubes and arm portion 16 to be shirred and gathered as needed to correspond to the size of the side of the recliner arm as shown in FIG. 2. The forward free ends of elastic bands 26, 28 are provide with fasteners, for example in the form of the male ends 34,34 of military or other type buckles. These fasteners are designed to mate, for example, with the female ends 36, 36 of the buckles, which are adjustably connected to the free ends of a second pair of elastic bands 38, 40 captured in tubes 42, 44 in the other arm portion 18.

The rear edge of the outer part of the arm portion 16, is provided with a zipper half 41 which can mate with a zipper half 43 connected to a remote edge of a back panel 46 that is sewn to a rear lower edge 45 of arm portion 18, and extends around the back of the bottom of the recliner back when the cover is fitted onto the recliner (see FIG. 2). Zipper 41, 43 holds the arm portions 16, 18 down around the base of the recliner and across the back of the recliner, covering a rear lower edge 13 of the head portion 12 (see FIG. 1).

The front edges 25,27 and front areas of the arm portions 16 and 18 are held against the front and sides of the recliner arms by pulling the elastic bands 26, 28 toward the elastic bands 38, 40 and connecting the buckle portions 34, 36 as shown in FIG. 2.

As with the bands 26 and 28 in their tubes 22, 24, the elastic bands 38, 40 are tethered or sewn into their tubes 42, 44 only at the rear bases of the tubes at 48, 48. This allows the elastic bands to freely slide within the tubes, allowing the tubes and fabric portions to be gathered or shirred on the bands to closely fit around the bottom of the recliner regardless of the size of the recliner.

To permit a close fit of the arm portions around the recliner arms and still allow free movement of the recliner footrest within the foot portion 14, the arm portion 16 is connected to the seat portion 20 at a seam 17 which ends at a point 19, before reaching the front edge 25 of the arm portion 16. A slit may also be used. As shown in FIG. 2, this allows some of the arm portion to wrap around the front of the recliner, somewhat covering the mechanism for extending the footrest while avoiding any obstruction to that mechanism. The connection between the other arm portion 18 and the other side of the seat 20 is the same.

In order to produce a custom fit of the seat 20 on and around the seat cushion of the recliner, seat 20 is manufactured with ample excess fabric at its connection with the arm portions and with the head and foot portions. This permits the fabric to be tucked and pushed down into the crease around the seat fabric. To insure an even more secure engagement of the seat portion onto the recliner seat, and the recliner cover in general onto the recliner, a tube 50 is sewn at the junction between the lower front edge of the head portion 12 and the rear edge of the seat portion 20. Tube 50 receives an elongated grip member 52 which, as shown at FIG. 2, can be tucked and pushed down into the space between the rear of the seat cushion and the base of the recliner back. A void or empty volume is generally provided in recliners in this area below the seat and between the back and the seat. The sleeve 50 with its grip member 52 tend to become wedged within this space, firmly stabilizing the cover to the recliner. The secure tucking action of this structure is more comprehensively explained in U.S. patent application 08/270,057 filed Jul. 1, 1994 by the co-inventors of the present application.

The excess fabric at the sides of the seat portion 20 are also tucked between the sides of the seat cushion and the arms of the recliner. Similar grip member 52 can also be tucked at the sides of the seat portion. Sufficient fabric is provided in the area between the seat portion 20 and the foot portion 14, so that the footrest can be extended as shown in FIG. 2 and folded down (not shown) without hindering the movement of the recliner.

A lever or handle shown at 21 in FIG. 2 may also be present in some recliners. As shown in FIG. 1, an opening or slot 23 is provided in the arm portion 18 to receive lever 21 and allow the cover to engage around the outer surface of the recliner, while the lever 21 extends outwardly of the cover.

In order to insure that the lower surface of the sleeve shaped foot portion 14 is securely held under the foot rest, whether the foot rest is in its lowered or raised position, the upper, inner edge of the foot portion 14 is provided with a tube or tube forming means 54, which can be closed using VELCRO fasteners (a trademark for a hook and loop fastening system) or other means. The tube 54 which can thus be opened and closed, can be wrapped around the upper connected elastic bands 26, 38 as shown in FIG. 2, and closed around the bands to engage the under surface of the foot portion 14 to the band. Whether in its raised or lowered position, the under surface of the foot portion 14 is held close against the under surface of the footrest.

In order to insure that all surfaces of the seat, back and arms are covered with fabric, a part of the seat portion 20 overlaps over a part of the sleeve shaped head portion 12 in areas 56. This fabric can be tucked into the creases provided between the seat, arms and back, for example, at crease 53 in FIG. 2, to cover all surfaces in this area. To facilitate a close fit, the sleeve shaped head portion 12 has a front panel 58 which is sewn to a side panel 60 up to a point 59, the remainder of these two panels being free from each other so that they can be individually tucked into spaces that are necessary to completely cover this area of the recliner.

Figure 3:
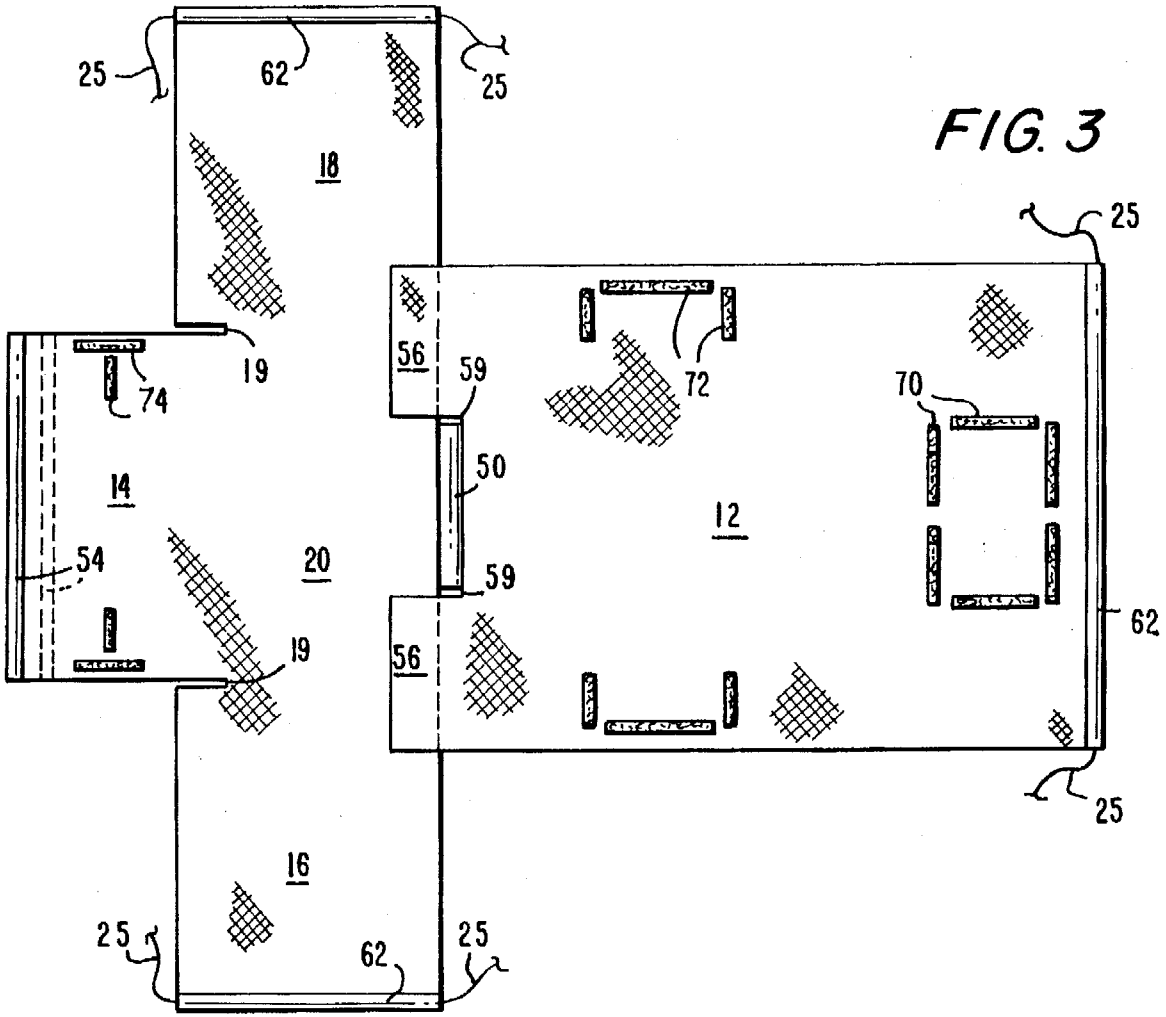
FIG. 3 is a top plan view of a second embodiment of the recliner cover.

Referring now to FIG. 3, which shows an alternate, simplified version of the present invention, the same reference numerals are utilized to designate the same or functionally similar parts.

In the embodiment of FIG. 3, the head and foot portions 12, 14 are substantially flat and planar and are sewn to the top and bottom edges of the seat portion 20.

The arm portion 16, 18 are also substantially flat and un-fitted, and are sewn to opposite sides of the seat 20, up to ends 19, to allow the foot portion 14 to move independently of the seat portion 20.

Tube forming structure 54 is also provided as is tube 50 for receiving a grip member. The overlapping fabric areas 56 are also provided at the junction between the head portion 12 and the seat portion 20.

Tubes 62 are provided at the outer ends of the arm portions 16 and 18 as well as the outer end (at 62) of the head portion 12. The tubes 62 may receive an elastic core or band 25 which, with the cover fitted onto the recliner, can be gathered together and tied or otherwise fastened, for example under the front of the recliner, in the position normally covered by the lowered footrest. As with the embodiment of FIG. 1, tube structure 52 can be used to engage around the elastic band 25 to help hold the undersurface of the foot portion 14 against the undersurface of the footrest.

Various additional velcro or other fasteners 70, 72 and 74 or tabs can be used about the head portion 12 and foot portion 14 to help hold the structures around the parts of the recliner. These are optional, however, since the available creases between the different parts of the recliner can be used to tuck portions of cover fabric in, and thus hold the cover to the recliner.

While specific embodiments of the invention have been shown and described in detail to illustrate the application of the principles of the invention, it will be understood that the invention may be embodied otherwise without departing from such principles.

What is claimed is:

1. A recliner cover for a recliner having a seat with a cushion, a back, a pair of arms and a movable footrest having upper and lower surfaces, the cover comprising:

a cross shaped fabric cover member;

the cover member having a head portion for engagement over the recliner back, a foot portion for engagement over the recliner footrest, a pair of arm portions for engagement over the recliner arms and a seat portion for covering the seat and sized for being tucked around the cushion;

the pair of arm portions being connected to opposite sides of the seat portion, the head portion is connected to a top end of the seat portion and the foot portion is connected to a bottom end of the seat portion;

skirt means connected to outer ends of the arm portions which are spaced away from the seat portion, for fastening around and covering a bottom of the recliner;

the skirt means including a fabric tube under the foot portion and at the outer end of each of the arm portions and a band engaging through the fabric tubes to hold the arm portions against the arms of the recliner and to hold the foot portion under the footrest; and the foot portion forming a sleeve including an inner part formed by superposed layers of said fabric cover for covering the lower surface of the footrest, said fabric tube of the foot portion being formed on one of said superposed layers and providing sleeve means for engaging the band for holding the inner part of the foot portion to the lower surface of the footrest.

2. A recliner cover according to claim 1 including a tube at an intersection between the head portion and the seat portion receiving a grip member to be tucked at a rear of the cushion and a grip member being received in said tube.

3. A recliner cover according to claim 1 wherein each of the head portion and foot portion comprise a sleeve for engagement respectively onto the back and footrest of the recliner.

4. A recliner cover according to claim 1 wherein the head portion is connected to the top end of the seat portion with parts of the head and seat portions overlapping each other.

5. A recliner cover according to claim 1 wherein the arm portions are connected to opposite sides of the seat portion at seams which end before a forward edge of each arm portion for permitting free movement between the foot portion and the arm portions.

6. A recliner cover according to claim 1 including a back panel connected to a rear edge of at least one of the arm portions and means for connecting the back panel to the other arm portion for forming part of the skirt means.

7. A recliner cover according to claim 6 wherein the skirt means includes a tube at the outer ends of each of the arm portions and an elastic band captured in each tube, the elastic bands being connected to each other for fastening the skirt means around the recliner.

8. A recliner cover for a recliner having a seat with a cushion, a back, a pair of arms and a movable footrest, the cover comprising:

a cross shaped fabric cover member;

the cover member having a head portion for engagement over the recliner back, a foot portion for engagement over the recliner footrest, a pair of arm portions for engagement over the recliner arms and a seat portion for covering the seat and sized for being tucked around the cushion;

the pair of arm portions being connected to opposite sides of the seat portion, the head portion is connected to a top end of the seat portion and the foot portion is connected to a bottom end of the seat portion;

skirt means comprising outer ends of the arm portions which are spaced away from the seat portion, for fastening around and covering a bottom of the recliner;

a back panel connected to a rear edge of at least one of the arm portions and means for connecting the back panel to the other arm portion for forming part of the skirt means;

said skirt means including a tube at the outer ends of each of the arm portions and an elastic band captured in each tube, the elastic bands being connected to each other for fastening the skirt means around the recliner and the bands being tethered only at one end of each band to its respective tube.

9. A recliner cover according to claim 8 including a tube in the cover member at a junction between the head portion and the seat portion for retaining a grip member.

10. A recliner cover according to claim 9 wherein the foot portion comprises a sleeve, the sleeve having an inner upper edge, and tube means at the inner upper edge for engagement with one of the bands for holding part of the foot portion against an under-surface of the footrest.

11. A recliner cover according to claim 10 including an opening in at least one of the arm portions for receiving a lever of the recliner.

12. A recliner cover according to claim 11 including a zipper connected to the cover member for connecting the back panel to the other arm portion.

13. A recliner cover according to claim 12 including a second tube spaced inwardly of the outer ends of the arm portions, a further band in each of the second tubes, and means for connecting the further bands to each other.

14. A recliner cover according to claim 13 wherein the tube means of the foot portion is positioned for engaging the further bands when they are connected to each other.

* * * * *